United States Patent [19]

Johansen

[11] 4,293,143

[45] Oct. 6, 1981

[54] SKI BINDING FOR CROSS-COUNTRY SKIS

[75] Inventor: Arne W. Johansen, Oslo, Norway

[73] Assignee: Adidas Fabrique de Chaussures de Sport, Dettwiller, France

[21] Appl. No.: 788,880

[22] Filed: Apr. 19, 1977

[51] Int. Cl.[3] ..... A63C 9/08

[52] U.S. Cl. ..... 280/615

[58] Field of Search ..... 280/614, 615, 635

[56] References Cited

U.S. PATENT DOCUMENTS

| | | | |
|---|---|---|---|
| 1,868,386 | 7/1932 | Gresvig | 280/615 |
| 2,022,580 | 11/1935 | Utterstrom | 280/615 |
| 3,466,056 | 9/1969 | Heyerdahl | 280/615 |
| 3,823,953 | 7/1974 | With | 280/615 |
| 3,874,684 | 4/1975 | Dysthe | 280/615 |

*Primary Examiner*—Robert B Reeves
*Assistant Examiner*—Gene A. Church
*Attorney, Agent, or Firm*—Brisebois & Kruger

[57] ABSTRACT

A ski binding with a toe iron which supports an essentially U-shaped bowed metal rod, whose middle section is pivotably attached to the front end of the toe iron. The backwardly-extending legs of the U-shaped rod are bent at an approximately right angle down toward the ski. The legs of the U are arranged so as to be freely movable in the horizontal direction against the legs' spring force out toward the ears of the toe iron. In cooperation with a boot sole which has notches cut into both side edges, the binding will be made to fasten when the boot is inserted with a degree of pressure in between the ears of the toe piece.

2 Claims, 6 Drawing Figures

SKI BINDING FOR CROSS-COUNTRY SKIS

The present invention relates to a ski binding having a toe iron which is to be attached to the ski, the toe iron providing support for an essentially U-shaped bowed metal rod, whose middle section is pivotably attached to the front end of the toe iron and whose backwardly-extending legs are bent down toward the ski at approximately a right angle, said legs being held clamped down during use by means of a spring or a locking device.

A binding of this type is described in Norwegian Pat. No. 128,698. Bindings of this known type must be pressed by hand into an open position, after which the ski boot can be inserted between the upstanding side edges of the toe piece and locked into place.

The purpose of the present invention is to provide a binding which can be fastened to the boot without it being necessary to manipulate the binding by hand, in other words, the boot can merely be inserted with a reasonable amount of force between the ears of the toe iron and is thereby automatically locked in place. This is achieved according to the invention by a ski binding of the above type which is characterized in that the bowed legs of the U are arranged so as to be freely movable against the legs' spring force out toward the ears of the toe iron, in a plane parallel to the toe iron mounting plate. To promote a more secure fastening of the boot in the binding, a preferred embodiment of the invention is characterized in that each of the upper edges of the ears on the toe iron, in a manner known per se, is provided with an inwardly-directed flange, there being provided in said flanges, open slots in the path of movement for the downwardly-directed portions of the legs. In cooperation with a boot sole which has notches cut into both side edges, the binding will be made to fasten when the boot is inserted with a degree of pressure in between the ears of the toe piece. The backwardly-directed legs of the U will be forced out toward the edges of the binding, and the downwardly-bent leg portions will slip into the notches on the boot.

The invention will be explained in greater detail in the following, with reference to the drawings, where FIG. 1 is a plan view of one embodiment of the binding according to the invention, as the ski boot is being inserted.

Figure 3:
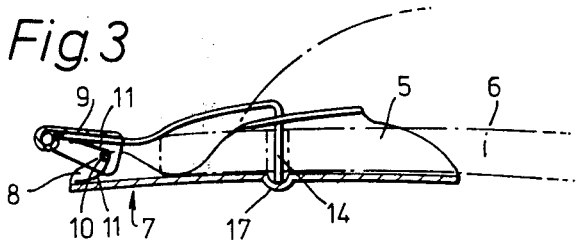
FIG. 3 shows the binding of FIGS. 1 and 2 in partial cross section and with the boot in the locked position.
Figure 6:
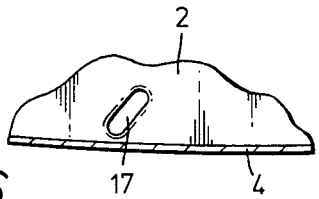
FIG. 6 is a plan view of a detail of the toe iron mounting plate.

The binding consists of a toe iron 1 with a mounting plate 2 having screw holes 3 for attaching the binding to a ski. Toe-iron ears 4 and 5 extend up from the outer edges of the mounting plate 2. The toe-iron ears are calculated to press against the edges of the sole 6 of a ski boot which is inserted into the binding, as indicated by the dashed lines. Each of the toe-iron ears 4 and 5 has an extension in the form of an inwardly-directed flange, 4' and 5', respectively. The mounting plate 2 has an extension 7 at the front whose edges are bent up to form supports 8 for an operative plate 9. The operative plate 9 is arranged partially rotatable in the supports 8 by means of a throughgoing bolt 10. Around the bolt 10, a rotatable/compression spring 11 is arranged which presses the operative plate 9 upwards. The middle 13 of an approximately U-shaped bowed rod 12 of spring steel is attached at the front end of the operative plate 9, its underside in contact with the bolt 10, such that the rod forms a two-armed lever. The free ends of the legs of the U are provided with downwardly-directed end portions 14. These downwardly-extending portions 14 pass through slots 15 and 16 in the inwardly-directed flanges 4' and 5' on the toe-iron ears 4 and 5. The free ends of the downwardly-extending portions 14 are guided into slots 17 in the mounting plate 2. These slots can either be stamped-out apertures or depressed grooves, as shown on FIGS. 3, 4 and 6.

Figure 2:
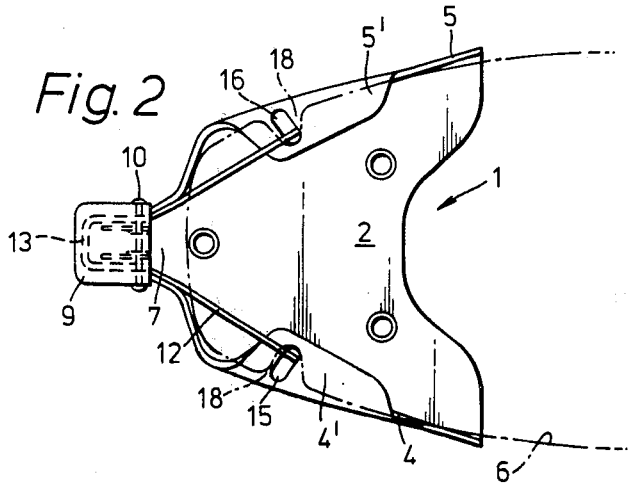
FIG. 2 shows the same binding as in FIG. 1, but with the ski boot in the locked position.

The bowed rod 12 is a spring, made such that it is forced toward the inner edges of the slots 15 and 16, in the position shown on FIG. 2.

Figure 1:
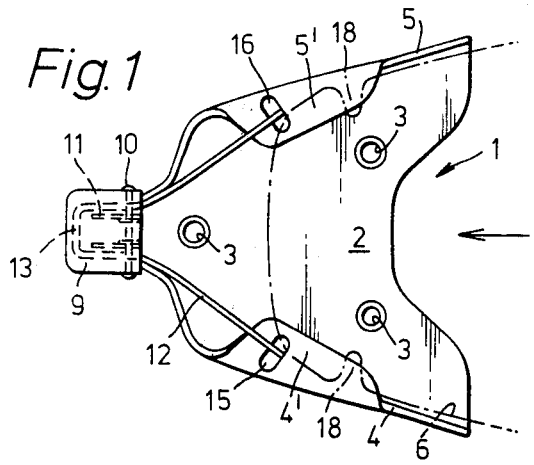

The binding according to the invention works in the following manner:

When the binding is to be put on, the tip of the boot sole is pressed into the toe iron, as shown on FIG. 1. The forward curve of the boot sole 6 will then press against the downwardly-directed portions 14 of the U legs, such that the boot sole can be inserted completely into the toe iron, the side edges of the boot then pressing against the inside of the toe-iron ears 4, 5. In this position, the downwardly-directed portions 14 of the U legs will then snap into outwardly-open grooves or notches 18 on the boot sole. These grooves can be provided with fittings so that they do not wear out so easily. The boot sole will then be quite securely locked in the binding, the edges of the boot sole pressing against the inside of the toe-iron ears 4 and 5 when the leg portions 14 have snapped into the notches 18 on the boot sole. There is no possibility of the binding's loosening, because the effect of trying to withdraw the boot will be that the leg portions 14 will get an even better grip in the notches 18. In addition, the leg portions 14 will have good support at both ends of the slots 15 and 16 in the toe-iron ears 4' and 5', as well as in the slots 17 in the mounting plate 2.

Figure 4:
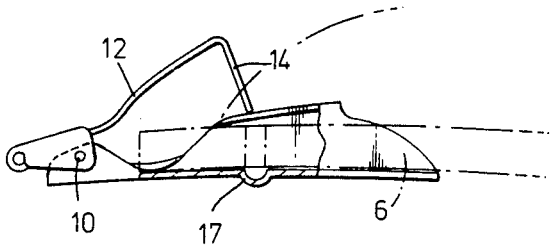
FIG. 4 shows the binding in the open position.
Figure 5:
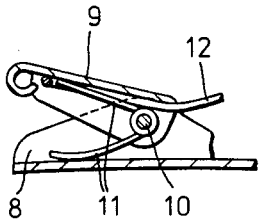
FIG. 5 is a detail drawing, on a larger scale, of the front end of the binding.

When the binding is to be released, one presses down on the plate 9, for example, with the end of a ski pole, which causes the U legs to tilt up into the position shown on FIG. 4. The boot can then be withdrawn from the binding.

The binding according to the invention offers a number of advantages—it is inexpensive to make, easy to put on and remove, and is safe during use.

Having described my invention, I claim:

1. A ski binding for a boot having a converging toe and laterally opening slots at each side of a forward portion of the sole of the boot comprising: a toe iron to be fixed to a ski, said toe iron being adapted to receive the forward portion of the boot upon forward movement of the boot relative to the toe iron; a locking device comprising a U-shaped bowed rod of spring material having rearwardly extending legs resiliently urged toward each other, each leg having an end bent to extend downwardly substantially perpendicular to the ski; mounting means mounting said locking device for pivotal movement of said legs from a lowered boot retaining position in which said ends of the legs engage in said slots, to an elevated boot releasing position in which said ends of the legs are vertically above said slots to permit rearward withdrawal of the boot; said mounting means including means mounting said legs while in said lowered position, to flex outwardly in response to forward insertion of the boot between the leg ends and to resiliently engage in said slots upon alignment of the slots with the leg ends, so that the boot can be moved into and locked in the toe iron without first moving said leg ends upwardly to said released position; and spring means for urging said leg ends to said lowered boot retaining position.

2. A ski binding according to claim 1 in which the toe iron comprises at its upper edge an inwardly directed flange having two slots into which said respective leg ends extend, said toe iron slots extending laterally along the path of travel of the leg ends to permit their outward flexing as the boot is inserted into the toe iron.

* * * * *